US006566990B2

(12) United States Patent
Oyama et al.

(10) Patent No.: US 6,566,990 B2
(45) Date of Patent: May 20, 2003

(54) ELECTROMAGNETIC ACTUATOR AND VALVE-OPEN-CLOSE MECHANISM

(75) Inventors: Hitoshi Oyama, Itami (JP); Takao Nishioka, Itami (JP); Kenji Matsunuma, Itami (JP); Kouichi Sogabe, Itami (JP)

(73) Assignee: Itami Works of Sumitomo Electric Industries, Ltd., Hyogo (JP)

( * ) Notice: Subject to any disclaimer, the term of this patent is extended or adjusted under 35 U.S.C. 154(b) by 0 days.

(21) Appl. No.: 09/729,348

(22) Filed: Dec. 5, 2000

(65) Prior Publication Data

US 2002/0053966 A1 May 9, 2002

(30) Foreign Application Priority Data

Dec. 9, 1999 (JP) ..... 11-349868
May 19, 2000 (JP) ..... 2000-148415
Oct. 20, 2000 (JP) ..... 2000-320702

(51) Int. Cl.[7] ..... H01F 7/08
(52) U.S. Cl. ..... 335/220; 251/129.15
(58) Field of Search ..... 335/219, 252, 335/256–262, 266, 276, 278, 279; 251/129.01–129.22; 123/90.11

(56) References Cited

U.S. PATENT DOCUMENTS 5,022,357 A * 6/1991 Kawamura ..... 123/90.11
5,076,222 A * 12/1991 Kawamura ..... 123/90.11
5,119,772 A * 6/1992 Kamamura ..... 123/90.11
RE34,591 E * 4/1994 Yoshida et al. ..... 239/96
5,752,308 A * 5/1998 Maley et al. ..... 335/253
6,182,646 B1 * 2/2001 Silberstein et al. .... 251/129.15
6,184,767 B1 * 2/2001 Pischinger et al. ..... 335/256

FOREIGN PATENT DOCUMENTS

EP 0922520 6/1999
EP 1004755 5/2000

OTHER PUBLICATIONS

European Search Report dated Aug. 2, 2001.

* cited by examiner

*Primary Examiner*—Lincoln Donovan
(74) *Attorney, Agent, or Firm*—McDermott, Will & Emery

(57) ABSTRACT

To lighten the weight of an electromagnetic actuator and a valve-open-close mechanism by forming the stems from a lighter material than conventional. A pair of electromagnets formed of stators and coils are opposed to each other with a gap therebetween. An armature is disposed in the gap so as to be reciprocable between one electromagnet and the other electromagnet by the electromagnets. A first stem for transmitting the movement of the armature from one electromagnet toward the other electromagnet to a valve of the internal combustion engine is inserted in a guide hole formed in the stator of one electromagnet. The first stem is formed of a lighter material than the armature to lighten the weight of the electromagnetic actuator and a valve-open-close mechanism of an internal combustion engine.

11 Claims, 4 Drawing Sheets

ELECTROMAGNETIC ACTUATOR AND VALVE-OPEN-CLOSE MECHANISM

BACKGROUND OF THE INVENTION

The present invention relates to an electromagnetic actuator and a valve-open-close mechanism used mainly in an automotive internal combustion engine.

Conventional electromagnetic actuators and valve-open-close mechanism are disclosed e.g. in Japanese patent publication 11-93629. Referring to FIG. 1, which shows one embodiment of this invention, an electromagnetic actuator 4 includes a pair of electromagnets 6, 7 each made up of a stator 5 and a coil 18 that are opposed to each other with a gap 10 therebetween. An armature 3 is disposed in the gap 10 so as to be reciprocable between two electrotromagnets 6, 7. A first stem 15 for transmitting the movement of the armature 3 from the other electromagnet 6 toward the one electromagnet 7 to a valve 9 for opening and closing a valve of an internal combustion engine is provided on one surface of the armature, namely, at the side where there is the electromagnet 7.

With this electromagnetic actuator, since the armature 3 is moved between the two electromagnets 6 and 7, it has to be made from a ferromagnetic material. Thus, for the armature 3, an iron-family or a steel-family magnetic material is ordinarily used. Since the first stem 15 is usually integral with the armature 3, an iron-family or steel-family material is used for the first stem 15, too.

Thus, because an iron-family or steel-family heavy material is used for both the armature 3 and the first stem 15, they have an influence on the driving power consumption of the electromagnetic actuator as inertia weight during operation. Thus, if such an electromagnetic actuator is used in an automobile, it will have a direct influence on the fuel consumption.

An object of the present invention is to reduce the weight of an electromagnetic actuator and a valve-open-close mechanism used in an internal combustion engine by forming its stems from a lighter material than conventional.

SUMMARY OF THE INVENTION

According to this invention, by forming the first stem 15 from a lighter material than conventional, it is possible to reduce the total weight of the combination of the armature 3 and the first stem 15, reduce the driving power consumption for the electromagnetic actuator as the inertia weight during operation, and reduce the fuel consumption if this is used in an automobile.

That is to say, a pair of electromagnets 6, 7 formed of stators 5 and coils 18 are opposed to each other with a gap 10 therebetween; an armature 3 is disposed in the gap 10 so that the armature 3 is reciprocable between one electromagnet 7 and the other electromagnet 6 by driving the electromagnets 6 and 7; a first stem 15 for transmitting the movement of the armature 3 from the other electromagnet 6 toward the one electromagnet 7 to a valve 9 of an internal combustion engine is inserted in a guide hole 22 formed in the stator 5 of the electromagnet 7; and the first stem 15 is formed of a lighter material than the armature 3.

Also, the electromagnetic actuator as described above is housed in a housing 8 which is mounted to an internal combustion engine body 19 by fixing members; a valve 9 for communicating an intake port 25 or an exhaust port 26 of the internal combustion engine with a combustion chamber 27 or shutting them off from each other is provided in the internal combustion engine body 19; the tip of the first stem 15 of the electromagnetic actuator is brought into abutment with the tip of the valve 9 so that by moving the armature 3 from the electromagnet 6 toward the electromagnet 7, the first stem 15 opens the valve 9 by pushing it; in order to impart a biasing force for carrying out a valve-closing operation to the valve, a retainer 13 is provided on the valve 9, and a first return spring 2 is mounted between the retainer 13 and the internal combustion engine body 19; by inserting a second stem 14 in a guide hole 22 provided in the stator 5 of the other electromagnet 6, it is detachably brought into contact with a surface of the armature 3 on the side not coupled to the first stem 15; and a retainer 13' is provided on the second stem 14, and a second return spring 1 for imparting a biasing force in the direction in which the second stem 14 pushes the armature 3 is mounted between the retainer 13' and the housing 8.

Since a light material compared with an iron-family or a steel-family member, which has a specific weight of 7 to 8, is used as the first stem 15, it is possible to reduce the total weight of an electromagnetic actuator for an internal combustion engine and an electronic valve-open-close mechanism for an internal combustion engine, and reduce the driving power consumption for the electromagnetic actuator as the inertial weight during operation.

Also, by coupling the armature 3 and the first stem 15 by slidable coupling, joining or mecahnical fastening, as in the case in which the stem and the armature are of iron or steel material and they are integral, the first stem 15 can transmit the movement of the armature 3 to the valve 9 of the internal combustion engine.

DETAILED DESCRIPTION OF THE PREFERRED EMBODIMENT

Figure 1:
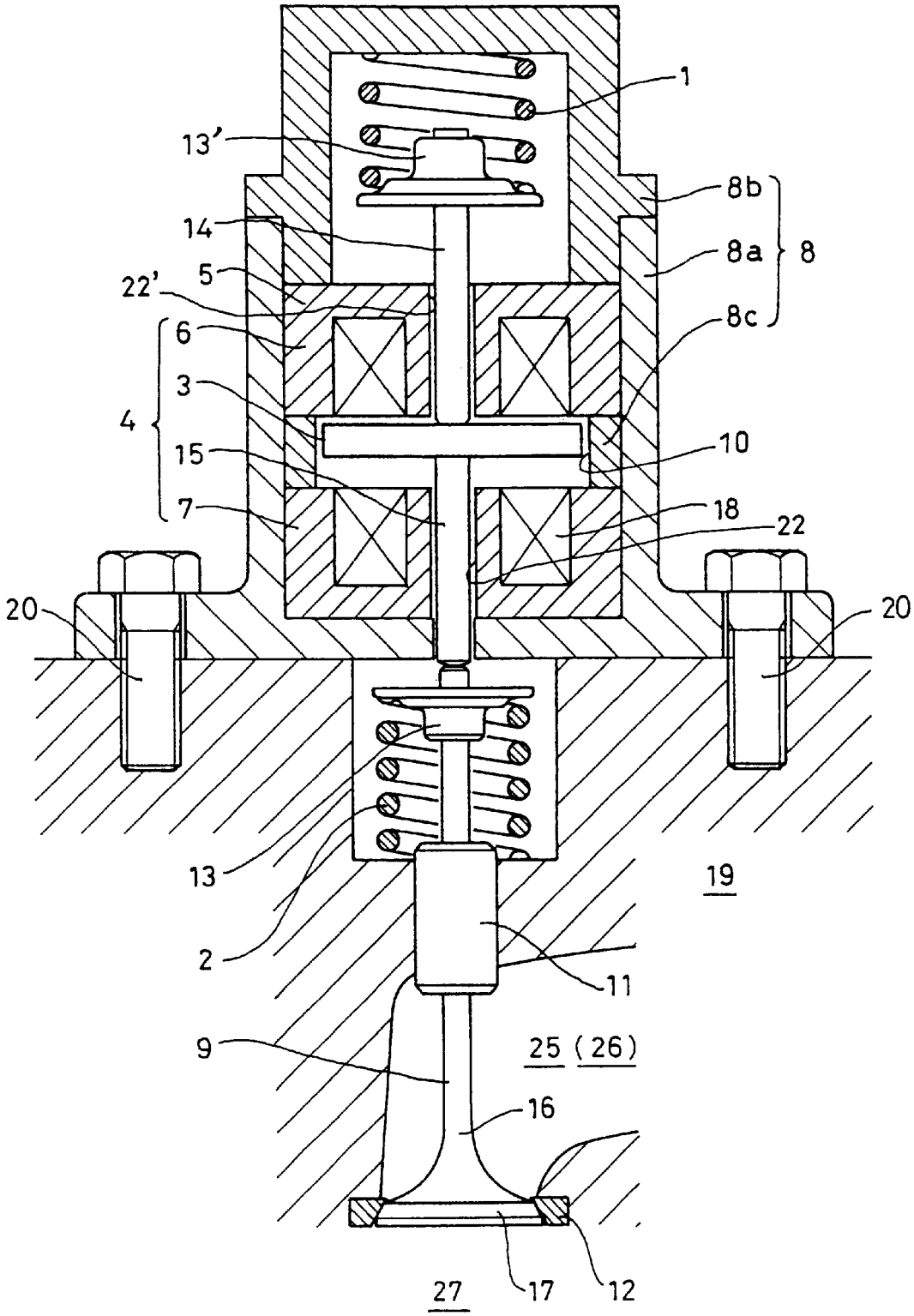
FIG. 1 is a sectional view of a valve open-close mechanism embodying the present invention.

The electromagnetic actuator 4 for an internal combustion engine according to this invention has, as shown in FIG. 1, a pair of electromagnets 6, 7, an armature 3, and a first stem 15 for transmitting a force acting on the armature 3 to external. The stem is made of a lighter material than the armature.

The armature 3 is mainly made from a magnetic material. The electromagnets 6, 7 are each made up of a stator 5 and a coil 18. By passing a current through the coils 18, a magnetic field is produced. The pair of electromagnets 6, 7 are provided opposite to each other with a gap 10 therebetween. The armature 3 is disposed in this gap 10. Thus, the armature 3 is reciprocable between the two electromagnets 6, 7 by the magnetic field produced by the electromagnets 6, 7. If the armature is joined or mechanically fastened to the first stem 15 or the second stem 14, by the first stem 15 or the second stem 14 or if an inter-electromagnet housing 8*c* is provided very close to the outer peripheral surface of the armature 3, using the inter-electromagnet housing 8*c* as a guide, the armature 3 can be smoothly reciprocated between two electromagnets 6, 7.

In order to transmit the movement of the armature 3 from one electromagnet 6 toward the other electromagnet 7, the first stem 15 is inserted in a guide hole 22 provided in the stator 5 of the electromagnet 7. By the first stem 15, the movement of the armature 3 from the side of the electromagnet 6 toward the side of the electromagnet 7 acts on the valve 9, which is in abutment with the tip of first stem 15, thereby opening the valve of the internal combustion engine.

The material of the armature 3 is, as described above, mainly a magnetic material. But, as will be described later, at the coupling portion between the armature 3 and the first stem 15, since they collide against each other or they are joined or mechanically fastened to each other, it is necessary to prevent deformation due to collision and make it easy to join or mechanically fasten them together. Thus, for an inner edge portion 3*b* of the coupling portion (FIG. 6) between the armature 3 and the first stem 15, it is preferable to use a harder steel than a soft magnetic material to some degree. Thus, it is preferable to form the armature body 3*a* from a magnetic material and the inner edge portion 3*b* from a material harder than the armature body 3*a*. These two steels can be integrated by joining.

As the material harder than the armature body 3*a*, an alloy tool steel such as SKS, SKD or SKT steel is preferable. Among them, if the armature is shrink-fit on the first stem 15, SKD or SNCM steel is preferable. As the magnetic material, soft magnetic iron such as SUYP steel or steel plates for magnetic pole such as PCYH and PCYC steel can be cited.

Here, as the lighter material than the armature 3, ceramic material whose major component is silicon nitride or SIALON, an aluminum alloy sintered material formed by molding an aluminum alloy powder by powder molding and then sintering it (hereinafter referred to as "aluminum alloy hardened material"), and a titanium alloy can be cited. The powder molding is a method in which a metallic powder is molded by a cold mold press molding, warm mold press molding or injection molding.

As the silicon nitride, to ensure reliability against breakage, use of a sintered material containing 80 wt % or more of silicon nitride or SIALON and having a relative density of 95 wt % or over is preferable.

Further, the ceramic material includes a fiber-reinforced ceramics and a whisker-reinforced ceramics.

As the aluminum alloy hardened material, it is required that it is a high-temperature slide member having a heat resistance in a sliding condition.

On the surface of the first stem 15, a ceramic coating film or a carbon-family coating film may be provided. This reduces the dynamic friction coefficient and possibility of seizure on the sliding surface when the first stem 15 is driven in the guide hole 22 of the stator 5 and thus reduces the energy loss due to sliding.

As the material forming the coating film, a ceramic coating film of a nitride, carbide, carbonitride, oxy-nitride, oxy-carbide or carbo-oxy-nitride of a metal in the IVa, Va, VIa groups of the periodic table or aluminum (Al), boron (B), silicon (Si), a DLC (diamond-like carbon) film, a diamond film or a carbon nitride film can be cited.

As the structure of the coating film, a coating film formed of one kind of material among the above materials, a mixed film formed of two kinds or more of them, and a laminated film formed of the above said coating film and the abovesaid mixed film. By providing such a coating film, it becomes unnecessary to forcibly supply lubricating oil to the sliding surface when the first stem 15 or the second stem 14 is driven in the guide hole 22 or 22' of the stator 5. This suppresses a failure of the actuator.

As a method of coupling the armature 3 and the first stem 15, slidably coupling them together, bonding them together, or mechanically coupling them together can be cited. With this arrangement, it is possible to form the armature 3 and the first stem 15 from different materials.

In the slidably coupling method, the first stem 15 is slidably mounted to the armature 3, and the first stem 15 and the armature 3 are coupled together so that the first stem 15 moves as the armature 3 moves from the side of one electromagnet 6 toward the other electromagnet 7.

Figure 6:
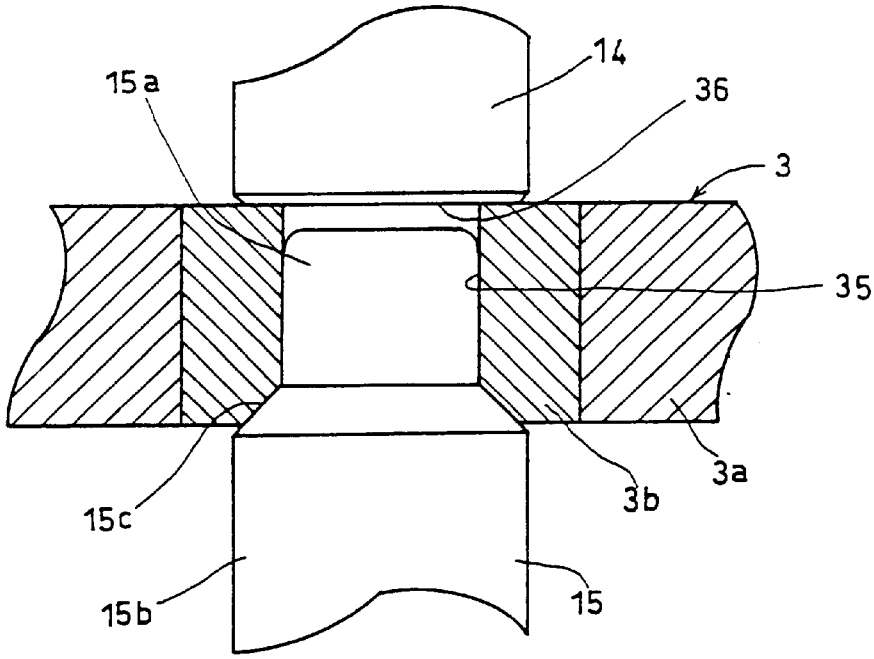
FIG. 6 is a sectional view showing how the armature is coupled to the first stem.

For example, as shown in FIG. 6, the coupling end portion 15*a* of the first stem 15 is slidably mounted in a hole 35 formed in the center of the armature 3. The coupling end portion 15*a* is formed to a smaller diameter than that of the first stem body 15*b*. The hole 35 has a smaller diameter than the diameter of the first stem body 15*b*.

In this case, the end face 15*c* of the first stem body 15*b* collides against the armature 3. Thus, when the armature 3 moves from the electromagnet 6 toward the electromagnet 7, this movement is reliably transmitted to the end face 15*c* of the first stem 15.

The diameter of the coupling end portion 15*a* and that of the hole 35 are not particularly limited so long as the portion 15*a* is slidable in the hole 35. But it is preferable that they have such diameters that the outer peripheral surface of the coupling end portion 15*a* and the peripheral surface of the hole 35 directly slide on each other, because shaking is prevented.

As shown in FIG. 6, if the end face 15*c* of the first stem body 15*b* is formed into a tapered surface extending toward the coupling end portion 15*a*, it becomes easy to align the axis of the armature 3 with the axis of the first stem 15 and thus to smoothly operate the armature 3 and the first stem 15.

Figure 7:
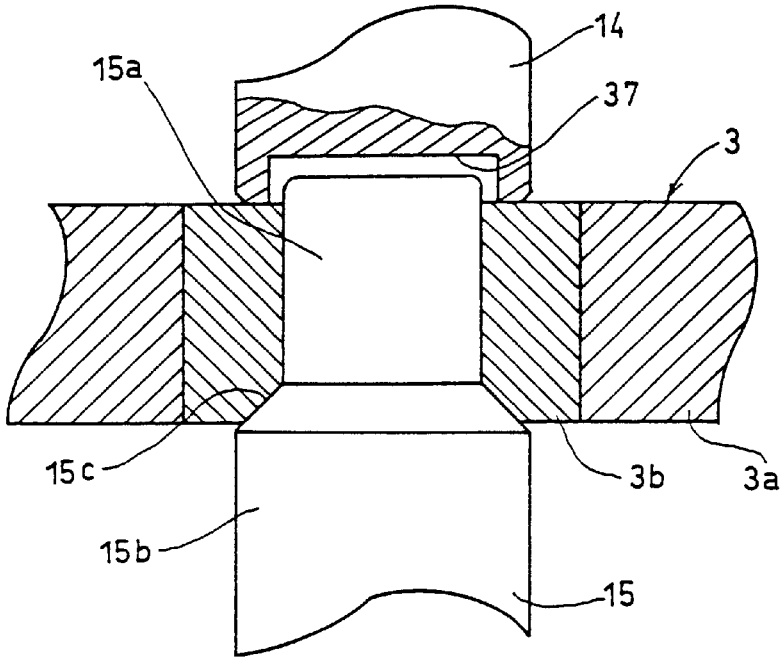
FIG. 7 is a sectional view showing another manner in which the armature is coupled to the first stem.

It is preferable that in the hole 35, there is left a hollow portion 36 when the coupling end portion 15*a* of the first stem 15 has been completely inserted into the hole 35 of the armature 3. This is because when the coupling end portion 15*a* has been completely inserted into the hole 35, if the hollow portion 36 is not provided between the first stem 15 and the second stem 14, the first stem 15 might collide against the bottom end of the second stem 14, so that the first stem 15 and the second stem 14 might directly influence each other not through the armature 3. This may make it impossible to control the actuator by the electromagnets 6, 7. When the coupling end portion 15*a* of the first stem 15 has been completely inserted into the hole 35 of the armature 3, if the tip of the coupling end portion 15*a* protrudes from the hole 35, as shown in FIG. 7, a hollow portion 37 may be provided at the bottom end of the second stem 14 so as not to collide against the tip of the coupling end portion 15*a*. With this arrangement, it is possible to prevent direct collision of the first stem 15 against the second stem 14.

As another example of the method of slidably coupling them together, though not shown, a non-through hole 35 may be provided in the center of the armature 3, and the end of the first stem 15 may be slidably mounted in this hole 35. The end of the first stem 15 in this case does not have to have a thinner diameter than the first stem body 15*b*. This is because the end of the first stem 15 directly collides against the bottom of the non-through hole 35 of the armature, so that through the bottom of the non-through hole 35, the movement of the armature 3 from the electromagnet 6 toward the electromagnet 7 can be transmitted to the first stem 15.

Further, as another method of slidable coupling, though not shown, an annular groove may be provided in the first stem 15 to receive an annular protrusion formed on the armature. This method ensures reliability of coupling.

As a method of coupling the armature 3 and the first stem 15 together by joining or mechanical clamping, bonding with an adhesive, chemical joining such as heat joining or pressing, and mechanical clamping such as caulking, shrink fit, cooling fit, threading and frictional pressing can be cited.

If the abovementioned ceramic material is used as the first stem, slidable coupling or shrink fit is preferable because coupling of the steel and ceramic material is simplified, and collapse of the ceramics is prevented.

The stators 5 may be manufactured by machining an iron-family material, but may be manufactured by molding an iron-family powder by powder molding.

In contrast, with a conventional electromagnet, as shown in FIG. 5, since a coil is wound around a stator 34 formed with a recess 32 to house an electromagnetic copper plate 31 or a guide hole 33 is formed by machining, it is large in volume as an electromagnet, and machining such as cutting is necessary.

Figure 4A:
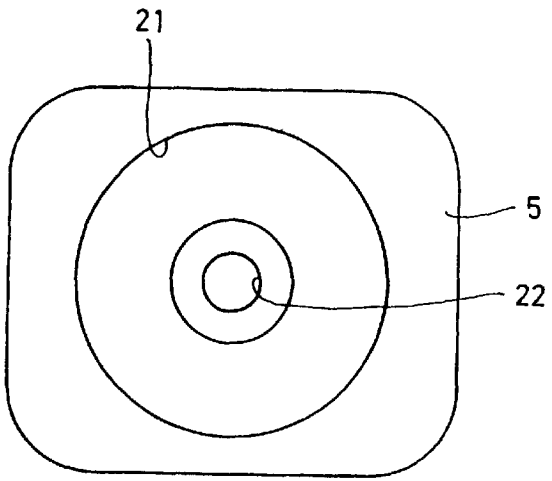
FIG. 4A is a plan view of a stator embodying this invention.
Figure 4B:
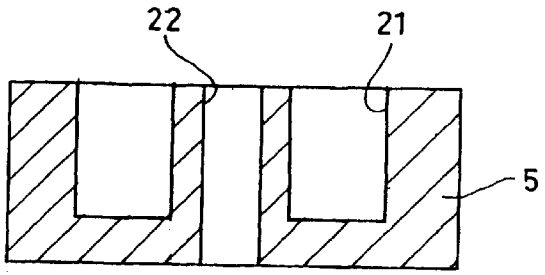
FIG. 4B is a sectional front view of the stator of FIG. 4A.

Thus, by employing by powder molding, as shown in FIG. 4, the recess 21 and the guide hole 22 can be formed with good accuracy, so that machining after molding can be omitted. Also, since it is possible to mount a pre-made coil in the recess, the number of manufacturing steps is fewer and mass-productivity is high.

In order to increase the density of the molded member obtained, obtain the same flux density as conventional electromagnets, and mold more compact stators 5, warm pressing or injection molding is advantageous.

The iron-family powder used for powder molding may be an ordinary iron-family powder, but an iron-family powder having an iron oxide film or a resin coated film is preferable. If powder molding is carried out using such an iron-family powder, as a constituent component of stators obtained, part or whole of the iron oxide film or coated resin film remains. Thus, formation of eddy current, which tends to be produced in a solid metal, is suppressed, so that stators with low iron loss are obtained. The iron oxide film is a film formed by oxidising the surface of an iron-family powder. The resin coated film is a film formed on the surface of an iron-family powder by applying, immersing or depositing a thermoplastic or thermosetting resin.

Thus, with the electromagnets using such stators, due to the effect of reduction in volume, reduction in volume of the constituent parts including the below-described housing is achieved, so that it is possible to reduce their weights.

Heretofore, when the stems were passed through the guide holes 33 of the stators 34, it was necessary to mount slide bearings. In contrast, if the above stators are used, since surface smoothness and dimensional accuracy of the molded members are assured, no slide bearings are necessary, so that it is possible to insert the first stem 15 and the second stem 14 into the guide holes 22, 22'. This leads to reduction of the number of parts, which in turn results in reduction in weight and improved mass-productivity.

The coils 18 may be formed from a copper-family material. But it is preferable to form them from aluminum or a material containing aluminum as its major component. With this arrangement, a reduction of weight of the coils 18 is achieved. As the coils 18, a 1000-family or 6000-family aluminum alloy specified in JIS H 4000 may be used. As a coating material of the coils 18, heat resistance of 180° C. or over is required. It may be an esterimide, a polyimide or a polyamide-imide.

Next, the valve-open-close mechanism for an internal combustion engine according to this invention comprises an electromagnetic actuator 4, a housing 8, a valve 9 and a second stem 14.

The electromagnetic actuator 4 is housed in a housing 8, which is fixed to an internal combustion engine body 19 by fixing members 20.

The housing 8 comprises, as shown in FIG. 1, a housing 8*a* covering the outer peripheral surfaces of the electromagnets 6 and 7, a housing 8*b* covering the top ends of the electromagnets 6, 7, and an inter-electromagnet housing 8*c* for keeping the gap 10 between the two electromagnets 6, 7. But as the housing, it is not limited to a structure formed of these three members but may be formed of any desired members according to the assembling conditions of the valve-open-close mechanism for an internal combustion engine according to this invention.

The material forming the housing 8 may be an iron-family material, but an impregnated composite material in which a metallic material has been impregnated into an aggregate comprising a metallic porous member is preferable. By using such a material, a housing high in strength is obtained. Also, reduction in the wall thickness of the housing and making it compact are possible. Thus, it is possible to lighten the weight.

The metallic porous member may be manufactured by subjecting a foamed resin to a conductive treatment with graphite or the like, electroplating it, and subjecting it to heat treatment to remove the foamed resin, or by impregnating a foamed resin with metal/resin slurry, drying and subjecting it to heat treatment to remove the foamed resin.

As the metallic porous member, a high-strength alloy material containing Fe, Cr, Ni, etc. is preferable. Its volume rate is, though it depends on the required strength and weight, preferably within the range of 3–20%.

As the metallic material to be impregnated into the aggregate comprising the metallic porous member, one or two or more selected from a material containing aluminum as its major component such as an aluminum metal, an aluminum alloy or the like, a material whose major component is a magnesium such as a magnesium metal or a magnesium alloy or the like, and foamed aluminum may be used.

As a method of impregnating an aggregate comprising a metallic porous member with a metallic material, a die-cast method, a high-pressure forging method such as molten metal forging, or an impregnation-forging method at a low pressure of several MPa or under can be used. This is because the cell hole diameter of the metallic porous member is of a relatively large size of 0.1 mm to 1 mm and it has an open-cell structure in which all cells communicate with one another.

The foamed aluminum is a foamed-state aluminum or aluminum alloy obtained by melting aluminum or an aluminum alloy such as an aluminum-calcium alloy, and adding a foaming agent such as titanium hydride or zirconium hydride to it to cause foaming by decomposition of the foaming agent.

With the thus obtained impregnated composite material, if an aluminum-family material or a magnesium-family material is used as the metallic material, it is possible to reduce the weight as a whole and thus the weight of the housing 8 itself.

The second stem 14 is inserted in the guide hole 22' of the stator 5 of the other electromagnet 6 to detachably bring it into contact with the surface of the armature 3 on its side not coupled to the first stem 15. As the material forming the second stem 14, for the same reasons as for the first stem, a material similar to that of the first stem can be used. Further, the first stem 15 and the second stem 14 may be formed of the same material or of different materials.

The second stem 14 may be, if necessary, joined or mechanically fastened to the armature 3, or may be separated from the latter. If the second stem 14 is separated from the armature 3, it becomes unnecessary to align the axes of the first stem 15 and the second stem 14 and to align the axes of the guide holes 22, 22' formed in the stators 5 of the electromagnets 6 and 7. This makes it easy to assemble the valve-open-close mechanism for an internal combustion engine according to this invention.

As the fixing members 20, bolts are usually used as shown in FIG. 1. As the material for the fixing members 20, an iron-family material can be used. But it is preferable to use a material whose major component is an aluminum such as aluminum metal or an aluminum alloy.

By using a material whose major component is aluminum as the fixing members 20, reduction in the weight is achieved. Also this is preferable because the internal combustion engine body 19 for mounting the housing 8, such as an engine head, is made from an aluminum-family material, so that it is possible to suppress stress due to a difference in the thermal expansion coefficient when a change in temperature occurs during assembling or operation. As specific examples of the material forming the fixing members 20, materials specified under JIS H 4000 are preferable. In view of tensile strength, 4000-, 5000-, 6000- and 7000-family materials (under JIS H 4000) are preferable.

For the internal combustion engine 19, a valve 9 for communicating an intake port 25 and an exhaust port 26 with a combustion chamber 27 and shutting them off is provided.

The valve 9 is formed from a marginal portion 17 forming a valve and a stem portion 16 forming a shaft. The material forming the valve 9 may be an iron-family material but may be such a material that the marginal portion 17 has heat resistance. For example, an aluminum alloy hardened material may be used as the stem portion 16 and a heat-resistant steel alloy as the marginal portion 17. A ceramic material whose major component is silicon nitride or SIALON may be used for both the stem portion 16 and marginal portion 17. By using these materials, it is possible to maintain heat resistance of the marginal portion 17 forming the valve and contribute to the reduction in weight.

As the heat-resistant steel alloy, JIS SUH3 (Fe-11 wt % Cr-2 wt % Si-1 wt % Mo-0.6 wt % Mn-0.4 wt % C) or the like can be cited as an example.

As the silicon nitride, to ensure reliability against breakage, use of a sintered member containing 80 wt % or more of silicon nitride or SIALON and having a relative density of 95 wt % or over is preferable.

The ceramics include fiber-reinforced ceramics and whisker-reinforced ceramics.

Since the aluminum alloy hardened material has heat resistance in a sliding condition, it is preferable that it has an alloy structure in which in fine aluminum-based crystal particles, a similarly fine intermetallic compound deposits to strengthen the heat resistance and also it is a dense material. As such an example, Al-17 wt %, Si-1.5 wt %, Zr-1.5%, Ni-2%, Fe-5%, Mm can be cited. Here, "Mm" is misch metal, namely, a composite metal formed mainly of rare earth elements such as lanthanum, cerium. By blowing high-pressure gas against alloy molten metal having such a composition, quenched solidified powder is formed. This is compressed, heated at about 500° C., and hot-forged to impart shapes for densification and at the same time to make it into a part. The thus obtained aluminum alloy hardened material having a predetermined shape is formed of fine aluminum-based crystal particles of about 100–1000 nm and strengthened by fine deposition of hard composite intermetallic compound of aluminum and other element metals on the base. The degree of densification is preferably 95% or over.

If such an aluminum alloy hardened material is used as the stem portion 16 and a heat-resistant steel alloy is used as the marginal portion 17, they can be joined together by hot pressing.

By making the stem portion 16 and the marginal portion 17 from different materials and joining them together, it is possible to form most part of the valve from an aluminum alloy and thus lighten the weight, and to selectively strengthen the portion that will be exposed to burning and heated to high temperature.

Also, for the aluminum alloy hardened material and titanium alloy material, in order to improve wear resistance of the sliding surface on the surface of the stem portion 16, the below-described ceramic coating film or carbon-family coating film, or an oxide film may be provided.

The valve 9 is provided such that by moving the armature 3 from the electromagnet 6 toward the electromagnet 7, the tip of the first stem 15 of the electromagnetic actuator 4 abuts the tip of the stem portion 16 of the valve 9 so that the valve opens.

In order to impart a biasing force for valve-closing operation to the valve 9, a retainer 13 is provided on the stem portion 16 of the valve 9 and a first return spring 2 is mounted between the retainer 13 and the internal combustion engine body 19.

Further, a valve guide 11 for guiding the valve-opening and closing motion is provided on the internal combustion engine body 19.

Specifically, the marginal portion 17 of the valve 9 is provided at the boundary between the intake port 25 or exhaust port 26 and the combustion chamber 27, and at the boundary, a valve seat 12 is mounted. The valve 9 is closed by the first return spring 2 and the intake port 25 and exhaust port 26 are shut off from the combustion chamber 27:. When the first stem 15 pushes the stem portion 16 of the valve 9 by the movement of the armature 3, the marginal portion 17 is pushed into the combustion chamber 27, so that the intake port 25 or exhaust port 26 and the combustion chamber 27 communicate with each other. Thereafter, by the biasing force imparted by the first return spring 2, the marginal portion 17 is again pressed against the valve seat 12, so that this line is shut off. Here, the valve seat 12 is a member for seating the marginal portion 17. This prevents the marginal portion 17 from directly colliding against the internal combustion engine body 19.

Also, the first return spring 2 is housed in a recess formed in the internal combustion engine body 19, and the valve guide 11 is provided so as to guide the stem portion 16 of the valve 9, which extends through the portion between the recess and the intake port 25 or exhaust port 26.

As for the material forming the retainers 13, 13', it may be an iron-family material. But for the purpose of reducing the inertia weight for improving the quick open-close properties of the valve 9 and reducing the total weight of the internal combustion engine, the abovementioned aluminum alloy hardened material is preferable. This is because high fatigue characteristics are required because they are subjected to repeated stresses from the compression springs. Thus it is necessary to adopt an alloy design in which fine crystal particles on a submicron order are formed and a quick-cool-solidifying process. By using this, it is possible to lessen the weights;of the retainers 13, 13' themselves.

As the aluminum alloy hardened material, the one used for the valve 9, first stem 15, second stem 14, etc. may be used. But since sliding occurs against the first return spring 2 and second return spring 1 during high-speed valve operation, an aluminum alloy is sometimes insufficient. In such a case, by using the above aluminum alloy powder containing 10 wt % hard particles having an average diameter of about 1–5 $\mu$m, and a maximum diameter of about 15 $\mu$m, it is possible to suppress wear. As the hard particles, nitride ceramic, oxide ceramic, carbide ceramic are preferable. As examples, silicone nitride, alumina, and silicon carbide can be cited.

The second stem 14 is provided at a surface opposite the surface of the armature 3 provided with the first stem 15. On the second stem 14, a retainer 13' is provided. Between the retainer 13' and the housing 8, the second return spring 1 for imparting a biasing force in the direction in which the second stem 14 pushes the armature 3 is provided.

The second return spring 1 opposes the biasing force of the first return spring 2, which acts on the armature 3 to prevent the armature from being pressed toward the other electromagnet 6 by the biasing force of the first return spring 2.

The material forming the first return spring 2 or the second return spring 1 may be an iron-family material. But by using the following material, namely, an alloy steel containing C: 0.55–0.70 wt %, Si: 1.0–2.2 wt %, Cr: 1 wt % or under, Mn: 1 wt % or under, V: 0.2 wt % or under, and if necessary, Mo and Nb, having a tensile strength of 1960 N/mm$^2$, inclusion such as $SiO_2$ and $Al_2O_2$ being 25 $\mu$m or under, and having a tempered martensitic structure, it is possible to obtain desired spring characteristics and lessen the spring weight. In the case of such a high-strength steel, after melt casting and hot pressing, it is worked to an intended wire diameter by combining shaving, wire drawing and patenting, and then hardening and tempering to obtain a steel wire. Thereafter, coiling, strain-removing annealing, shot peening, and if necessary, nitriding, shot peening and strain-removing annealing are usually carried out.

Further, as the material of the first return spring 2 or second return spring 1, if a titanium alloy comprising a total of 13 wt % of Al and V, having a tensile strength of 1500 N/mm$^2$ and having a surface coating that is good in wear resistance is used, it is possible to obtain desired spring characteristics and lessen the spring weight. The high-strength titanium alloy is melted in a vacuum, melt-forged repeatedly until component segregation decreases sufficiently, hot-pressed, then solution treatment and wire drawing repeatedly. After it has been worked to an intended wire diameter, it is subjected to ageing treatment. The steps after coiling are basically the same as mentioned above.

Furthermore, as the material of the first return spring 2 or second return spring 1, if an aluminum alloy containing a total of 5 wt % or more of Cu, Mg and Zn, having long crystal particles having an aspect ratio of the crystal particle diameter of 3 or over, and a tensile strength of 600 N/mm$^2$ or over, it is possible to obtain desired spring characteristics and lessen the spring weight. The high-strength aluminum alloy is formed into a powder of an intended composition, the powder is solidified into an ingot, and subjected to either or both of forging and pressing, wire drawing and solution treatment repeatedly to an intended wire diameter, and finally, ageing treatment. The steps after coiling are basically the same as with high-strength steel but no nitriding is done.

Also, in order to use the abovementioned titanium alloy and aluminum alloy for the first return spring 2 or second return spring 1, a coating film may be provided to improve the wear resistance of the surface, if necessary.

Figure 2:
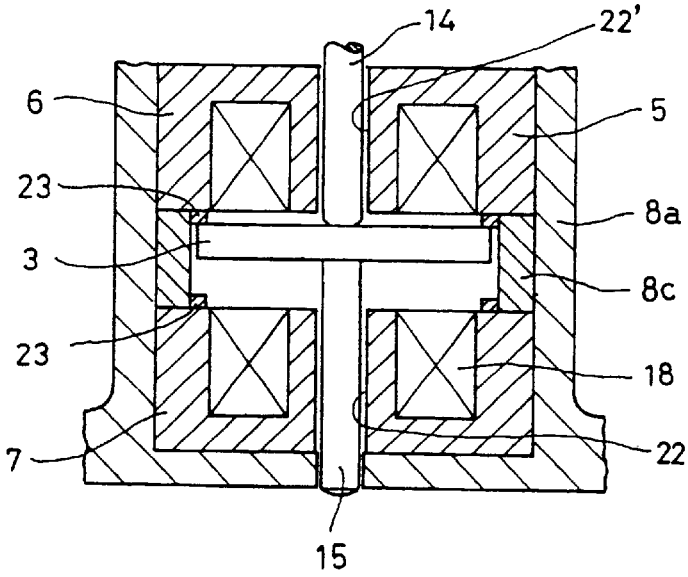
FIG. 2 is an enlarged sectional view of a portion of another embodiment.
Figure 3:
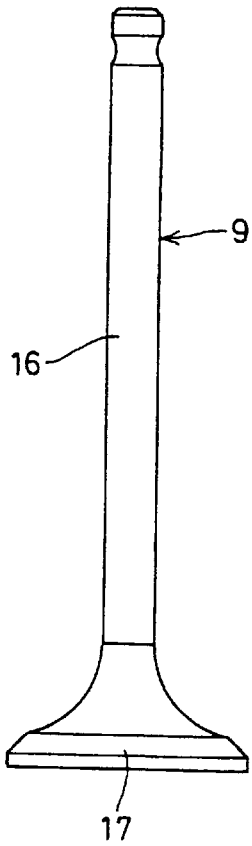
FIG. 3 is a front view showing a valve.

In this invention, if the stator 5 is formed by molding an iron-family powder by powder molding, during operation of the valve-open-close mechanism, if the armature 3 and the stator 5 contact directly each other, it is liable to wear or chipping. Thus, it is preferable to reciprocate the armature 3 so as not to directly contact the stator 5. For this purpose, the reciprocating motion of the armature 3 may be controlled by an electric circuit, or stoppers 23 may be provided between the stator 5 and the armature 3 as shown in FIG. 2.

It is not necessary to manufacture all of the first stem 15, second stem 14, housing 8, valve 9, first return spring 2, second return spring 1, retainers 13, 13' and fixing members 20 of the above-described metal or its alloy, which is smaller in specific weight than iron, an alloy or a ceramic or a fiber- or whisker-reinforced ceramic reinforced with an aggregate which is smaller in specific weight than iron. Even if at least one of them is formed of such a material, and the others are formed of an iron-family material, it is possible to achieve lessening the weight of an electromagnetic actuator for an internal combustion engine or a valve-open-close mechanism for an internal combustion engine obtained.

EXAMPLES 1, 2

The parts forming the valve-open-close mechanism shown in FIG. 1 were manufactured from the following materials to form the valve-open-close mechanism.

(Armature)

As the armature 3, using SKD steel for the inner edge portion and PCYH steel for the armature body, they were welded together. As shown in FIG. 6, at the bottom end of the hole 35, a tapered surface was formed so as to be in contact with the tapered end face 15*c* of the first stem 15.

(Stems)

As the first stem 15 and second stem 14, specimens made in the following manner were used. A powder in which 5 wt % of yttrium oxide and 2 wt % of aluminum oxide were wet-blended in ethanol into a commercial silicon nitride powder ($\alpha$-crystal phase ratio: 90% or over, average particle diameter: 0.8 $\mu$m) was dried. After a predetermined molding organic binder had been added, the mixture was molded. Sintering was carried out at 1800 degrees in a 4-atm nitrogen gas atmosphere for 10 hours, and it was worked into a predetermined shape with a diamond grindstone. For this sintered member and a sintered member manufactured simultaneously, the three-point bending strength was measured under JIS R 1601. The average strength was 1050 MPa.

As its shape, it had such a shape that as shown in FIG. 6, it had at the end to be coupled to the armature 3 a coupling end 15*a* smaller in diameter than the first stem body 15*b* and a tapered end face 15*c*.

(Coupling of the Armature and the First Stem)

Coupling ①: As shown in FIG. 6, the coupling end 15*a* of the first stem member 15 was inserted in the hole 35 of the armature 3 so as to slidably couple it.

Coupling ②: The coupling end 15*a* of the first stem member 15 was inserted in the hole 35 of the heated armature 3 and the armature was let to cool to fasten them together by shrink fit.

(Stator)

The stator 5 of a shape shown in FIG. 4 was manufactured from a powder compressed molded body. Iron powder used was pure iron powder. It was manufactured by steps of preparing a powder solidified by quenching by blowing high-pressure water against molten metal, drying, and adjusting powder particle diameter distribution by passing through a mesh of a predetermined size. These steps are the same as in manufacturing an ordinary starting raw material powder for sintered machine parts. Thereafter, in order to assure insulation between pure iron powders, an oxide film forming step was carried out by heat treatment.

Main impurities before the formation of an oxide film were about 0.1 wt % of oxygen, about 0.05 wt % of Si and Mn, and about 0.005 wt % of carbon, phosphorus and sulfur. The powder particle diameter is controlled in the quench-solidifying step and the particle diameter distribution adjustment step for smooth and uniform flow filling into a mold, and so that as high an apparent density as possible is obtained. The particle diameter distribution thus obtained was such that 5–10 wt % were less than 200 $\mu$m and 150 $\mu$m or over, 40–50 wt % were less than 150 $\mu$m and 75 $\mu$m or over, and 40–50 wt % were less than 75 $\mu$m and 30 $\mu$m or over. According to the flow property evaluation under JSPM standard, which is an index of flow filling properties, for the powder having such a particle diameter distribution, the time taken for 50 grams of powder housed in a funnel container having an outlet diameter of 2.5 mm to pass the outlet was 20–30 seconds. Also, the apparent density under the standard was 2.9–3.5 g/cm$^3$.

In order to: manufacture the stator by molding this powder, the powder was charged into a mold, and in order to prevent seizure between the mold and the iron powder in uniaxially compressing, 0.5–0.7 wt % of organic resin containing a thermosetting resin as its major component was blended.

The powder compressed molded body obtained by cold-compression-molding the powder was 7.1 g/cm$^3$ in density. For a powder compressed molded material obtained by warm compression molding, the density was 7.4 g/cm$^3$. In warm compression molding, the mold and the powder to be compressed were controlled to a temperature of 130° C. to 150° C. The reason why the density was high in this case was mainly because the yield stress of the iron powder decreased-and the deformability increased due to softening, so that-the consolidation property increased.

These molded members were calcined at 200° C. in the atmosphere to obtain stators.

Generally, in an alternating magnetic field, the higher the frequency, the more an eddy current is produced and the more loss of magnetic force occurs. But with an aggregate of such a powder, production of eddy current is suppressed in the powder units, so that it is possible to lower the loss. With this stator, due to its structural feature, there is little anisotropy in permeability. Dimensional variations after molding and calcining were small, so that no additional working was necessary. Thus, there was no need to set a bearing for passing the stem.

Figure 5A:
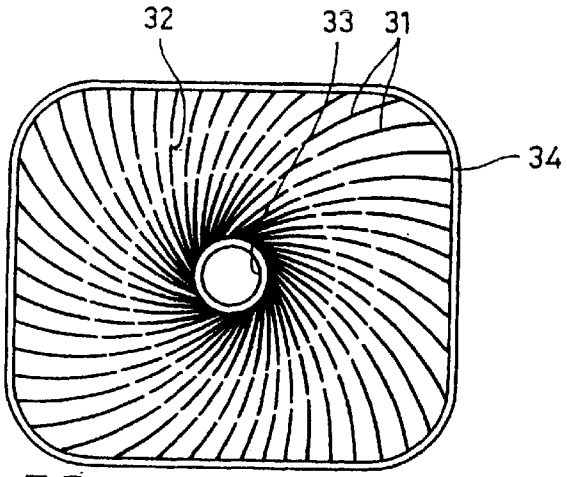
FIG. 5A PRIOR ART
FIG. 5A is a plan view of a conventional stator.
Figure 5B:
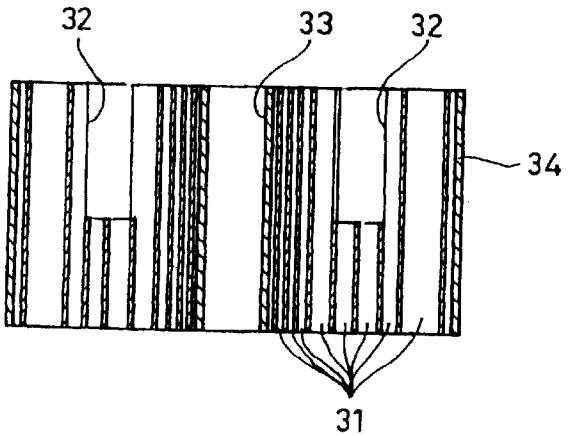
FIG. 5B PRIOR ART
FIG. 5B is a sectional front view of the conventional stator.

Comparative members were manufactured of a laminated silicon steel plate. For the laminated silicon steel plate, in view of the balance of punching workability and higher permeability than iron, a unidirectional silicon steel plate containing 3 wt % silicon was used. Since anisotropism is produced that the permeability is large in the rolling direction and small in a normal direction, as shown in FIGS. 5A and 5B, a laminated structure was used. For the purpose of suppressing eddy current, on the surface of the steel plate, an electric insulating resin layer was formed and it was assembled by superposing steel plates. Plates punched into strips were laminated and assembled, and fixed together by welding their ends with a laser. As for the accuracy of this stator, since the accuracy of the steel plate itself and the accuracy at the time of laminating and assembling are multiplied, it is impossible to expect a high dimensional accuracy compared with a stator formed by powder compression. Thus, machining was necessary at the end face on the side where the housing and the armature contact with each other. Also, the dimensional accuracy of the hole for receiving the stem was also low, so that additional working and setting a bearing were necessary. The assembled laminated steel plate member had a density of 7.8 g/cm$^3$.

The maximum flux density for direct current of the stators thus formed by powder compression molding was 1.3 T for cold-molded members and 1.5 T for warm-molded members. In contrast, the maximum flux density for direct current when laminated silicon steel was used was 1.3 T.

From the above results, compared with laminated silicon copper plates, for powder compression molded members, it was confirmed that they showed equivalent or more than equivalent magnetic properties, though they were low in density and small in the number of manufacturing steps.

(Coil)

As the coil 18, a 6000-family material having a conductivy of 50% IACS specified in JIS H 4000 was used instead of a conventional copper-family material. As a coating material for the coil member, a polyimide resin was used.

(Housing)

The housing 8 was manufactured by the following method. A slurry was prepared by mixing 65 parts by weight of Ni powder containing 18% Fe having an average diameter of 2.5 $\mu$m and 8% Cr, 2 parts by weight of a dispersant, 11 parts by weight of water and 12 parts by weight of phenolic resin. The slurry was impregnated into a polyurethane foam which had a thickness of 8 mm and in which the cell number per inch was 29, and excess slurry that adhered was removed by use of a metallic roll, and the sheet was dried for 10 minutes at 120° C. By heat-treating this sheet at 1200° C. under vacuum for one hour, a porous metallic member having a density of 0.91 g/cm$^3$ was prepared. After the metallic porous member has been worked into a cylindrical shape, it was set in a mold. By injecting under pressure of 1.2 MPa molten metal aluminum alloy (Al containing 2 wt % Cu) heated to 760° C. a housing comprising a metallic porous member/aluminum alloy composite material was manufactured. As a comparative member, a housing was also formed from only an aluminum alloy without compositing the metallic porous member. The tensile strength measured for each of them was as follows: composite material: 231 MPa, aluminum alloy: 142 MPa.

ps (Return spring)

The return spring was manufactured by the following method. By repeatedly subjecting a steel comprising C=0.65 wt %, Si=1.98 wt %, Mn=0.78 wt %, Cr=0.75 wt %, V=0.11 wt %, the remainder being substantially Fe to melt-forging, rolling, shaving, wire drawing, and heat treatment to obtain a wire 3.0 mm in diameter. Non-metallic inclusion were 20 μm at maximum. From this wire, a high-strength coil spring was manufactured by combining coiling, strain-removing annealing, shot peening and nitriding.

(Retainers)

For the retainers 13, 13', because they retain the valve through a retaining part called cotter (retainer lock), and make a high-speed reciprocating motion integral with :the valve 9, heat fatigue strength and shock strength are required. Also, with the rotation of the valve 9, they slide against the first return spring 2 and the second return spring 1, so that wear resistance is also required. To assure heat fatigue strength and shock strength, for an aluminum alloy, an alloy design for forming submicron fine crystal particles and a rapid-cool-solidifying process are required. As such an aluminum alloy, using Al-17 wt %, Si-1.52 wt %, Zr-1. 5 wt %, Ni-2 wt %, Fe-5 wt %, Mn, an aluminum powder having an average particle diameter of 50 μm was manufactured by gas cooling solidifying process and it was used as a starting material. Also, in view of the requirement of wear resistance, because it is difficult to deal only with an aluminum alloy, as hard particles, 9 wt % of alumina particles having an average particle diameter of 2 μm and a maximum particle diameter of 12 μm were added.

After uniaxial powder compression molding, it was heated at 500° C. and densification and imparting final-shape were carried out simultaneously by hot forging. Thereafter, in order to remove burrs and layers at the surface-layer portion where powder bonding was weak, barrel treatment was carried out. No machining was carried out. The density was 3.2 g/cm$^3$.

For conventional retainers, steels for machine structures such as JIS 17C or if circumstances require, alloy steels such as JIS 17C SCr415 are often used. The retainer as a comparative member was manufactured using the latter. After shape imparting to the latter alloy steel by hot forging, it was roughly machined, carburized and annealed and then finish working was done. The density was 7.8 g/cm$^3$.

(Bolts)

As the bolts used for mounting the housing 8 to the internal combustion engine body 19, a 4000-family material stipulated under JIS H 4000 was used against a conventional steel material.

(Valve)

As the valve 9, 5 wt % of yttrium oxide and 2 wt % of aluminum oxide were wet-blended into a commercial silicon nitride powder (α-crystal phase ratio: 90% or over, average particle diameter: 0.8 μm) in ethanol. The powder obtained was dried. After a predetermined organic molding binder had been added, predetermined molding was carried out. Thereafter sintering was carried out at 1800 degrees in a 4-atm-pressure nitrogen gas atmosphere for 10 hours, and it was worked into a specimen of predetermined shape by a diamond grindstone. For this sintered member,and a sintered member manufactured simultaneously, when the three-point bending strengths were measured under JIS R 1601, the average strength was 1050 MPa.

(Valve-open-close Mechanism)

Using the abovesaid parts, electromagnetic actuators and valve-open-close mechanisms were manufactured.

EXAMPLES 3, 4

Except that as the stem, the following stem was used, electromagnetic actuators and valve-open-close mechanisms were manufactured in the same manner as in Example 1.

(Stem)

On the surface of the stem manufactured in Example 1, a DLC film was formed in the following method which is a known capacitive coupling type plasma CVD method. A stem base member washed with a solvent or a detergent and dried was mounted to an electrode connected to a high-frequency power source (frequency: 13.56 MHz). After exhausting at a degree of vacuum of $1\times10^{-4}$ Pa, argon gas was introduced until it was maintained at a pressure of $1\times10^{-1}$ Pa. In this state, a high frequency output of 400 W was supplied to the electrode from the high-frequency power source, and maintained for 15 minutes so that the electrode carrying the stem would be covered by plasma. After a natural oxide film on the surface of the base member had been removed by ion cleaning, the supply of argon gas was stopped and methane gas was introduced until it was maintained at a pressure of $1\times10^{-1}$ Pa, and a high frequency output of 600 W was supplied to the electrode from the high-frequency power source to form a DLC film. The film thickness was about 1 μm.

COMPARATIVE EXAMPLE 1

Using the abovesaid comparative members for the stator, housing and retainer, and parts formed of an iron-family material for the other parts, an electromagnetic actuator and a valve-open-close mechanism were manufactured.

[Results]

The weights for Examples 1–4 and Comparative Example 1 were measured. For Examples 1 and 2, compared with Comparative Example 1, as the total weight, 70 wt % of weight reduction was achieved.

Also, performance tests were conducted for the valve-open-close mechanisms of Examples 1 and 2 and those of Examples 3 and 4 using a 12 V direct current constant-voltage power source. Power consumption at that time was measured. As a result, in Examples 3 and 4, the consumed power reduced by 20% compared with Examples 1 and 2. Thus, it was found out that by the formation of the DLC film on the surface of the stem, it, was possible to further reduce the sliding resistance between the stator and the stem.

Further, in the case of Example 1, although the armature 3 and the first stem 15 were coupled by a free-clamp structure, it was possible to sufficiently transmit the movement of the armature 3 to the first stem 15, and no trouble occurred in opening and closing of the valve.

Since a lighter material is used for the first and second stems, it is possible to lessen the weight of the electromagnetic actuator and the valve-open-close mechanism.

Even if the first stem and the armature are slidably coupled, it is possible to sufficiently transmit the movement of the armature to the first stem.

Further, when the first stem and the armature are coupled together by joining or mechanical fastening, the coupling therebetween becomes more firm, so that the movement of the armature can be more reliably transmitted to the first stem.

We claim:

1. An electromagnetic actuator comprising:

a first and a second electromagnet, each comprising a stator and a coil, and opposing each other in an axial direction of said actuator with a gap disposed therebetween, a disc-shaped armature mounted in said gap so as to be reciprocable in said gap in the axial direction, said armature having a surface opposing said first electromagnet, and a hole formed so as to extend in the axial direction, said first electromagnet having a guide hole extending therethrough in the axial direction and communicating with said gap, and a first stem extending through said guide hole and having one end thereof protruding into said gap and slidably inserted into said hole formed in said armature for transmitting a force that acts on said armature to an external load, said first stem having at said one end thereof a first abutment surface that is not parallel to the axial direction, said hole having an inner wall partially formed with a second abutment surface that is not parallel to the axial direction and adapted to engage said first abutment surface, thereby preventing said first stem from moving toward said second electromagnet relative to said armature with said first and second abutment surfaces engaging each other.

2. The electromagnetic actuator as claimed in claim 1 wherein said first stem has a small-diameter portion formed at said one end, and a large-diameter portion, said first abutment surface is a shoulder portion defined between said small-diameter portion and said large-diameter portion, said second abutment surface is a chamfered surface formed at the edge of said hole formed in the armature.

3. The electromagnetic actuator as claimed in claim 1 wherein said hole formed in the armature is a blind hole having a closed end defining said second abutment surface, and wherein said first abutment surface is an end face of said first stem at said one end.

4. A valve open-close mechanism for an internal combustion engine, said mechanism comprising the electromagnetic actuator as claimed in claim 1 a housing for housing said electromagnetic actuator, said housing being mounted to an internal combustion engine body by fixing members;

a valve provided in said internal combustion engine body for communicating an intake port or an exhaust port of the internal combustion engine with a combustion chamber or shutting them off from each other;

the tip of said first stem of said electromagnetic actuator being brought into abutment with the tip of said valve so that by moving said armature from said one electromagnet toward said other electromagnet, said first stem opens said valve by pushing said valve;

a first retainer provided on said valve for imparting a biasing force for a valve-closing operation, and a first return spring mounted between said first retainer and the internal combustion engine body;

by inserting said second stem in a hole provided in said stator of said other electromagnet, said second stem being detachably brought into contact with a surface of said armature on the side not coupled to said first stem; and a second retainer provided on said second stem, and a second return spring mounted between said second retainer and said housing for imparting a biasing force.

5. The valve open-close mechanism for an internal combustion engine as claimed in claim 4 wherein said second stem is formed of a lighter material than said armature.

6. The valve open-close mechanism for an internal combustion engine as claimed in claim 4 wherein said second stem is formed of a ceramic material having silicon nitride or SIALON as its major component, an aluminum sintered member molded by powder molding, or a titanium alloy.

7. The valve open-close mechanism for an internal combustion engine as claimed in claim 4 wherein said hole of said armature is a through hole, when said first stem has been completely inserted into said hole, there exists a hollow portion between said first stem and said second stem.

8. A valve open-close mechanism for an internal combustion engine, said mechanism comprising:

an electromagnetic actuator comprising a pair of electromagnets each comprising a stator and a coil, and a movable element comprising an armature and a first stem for transmitting a force that acts on said armature to an external load, characterized in that said first stem is made of a lighter material than said armature, wherein said armature comprises an armature body having a hole and an inner portion covering the surface of said hole, said armature body being formed of a magentic material and said inner portion being formed of a material having a higher hardness than said magnetic material, and wherein said armature and said first stem are coupled together by fixing said first stem to said inner portion by joining or mechanical fastening; and a housing for housing said electromagnetic actuator, said housing being mounted to an internal combustion engine body by fixing members;

a valve provided in said internal combustion engine body for communicating an intake port or an exhaust port of the internal combustion engine with a combustion chamber or shutting them off from each other;

the tip of said first stem of said electromagnetic actuator being brought into abutment with the tip of said valve so that by moving said armature from said one electromagnet toward said other electromagnet, said first stem opens said valve by pushing said valve;

a first retainer provided on said valve for imparting a biasing force for a valve-closing operation, and a first return spring mounted between said first retainer and the internal combustion engine body;

by inserting said second stem in a hole provided in said stator of said other electromagnet, said second stem being detachably brought into contact with a surface of said armature on the side not coupled to said first stem; and a second retainer provided on said second stem, and a second return spring mounted between said second retainer and said housing for imparting a biasing force.

9. The valve open-close mechanism for an internal combustion engine as claimed in claim 8, wherein said second stem is formed of a lighter material than said armature.

10. The valve open-close mechanism for an internal combustion engine as claimed in claim 8, wherein said second stem is formed of a ceramic material having silicon nitride of SIALON as its major component, an aluminum sintered member molded by powder molding, or a titanium alloy.

11. The valve open-close mechanism for an internal combustion engine as claimed in claim 8, wherein said hole of said armature is a through hole, when said first stem has been completely inserted into said hole, there exists a hollow portion between said first stem and said second stem.

* * * * *